US006780831B2

(12) United States Patent
Hamunen

(10) Patent No.: US 6,780,831 B2
(45) Date of Patent: Aug. 24, 2004

(54) PROCESS FOR SEPARATING UNSAPONIFIABLE VALUABLE SUBSTANCES FROM SULPHATE SOAP BASED MATERIALS

(75) Inventor: Antti Hamunen, Raisio (FI)

(73) Assignee: Raisio Benecol, Ltd., Raisio (FI)

( * ) Notice: Subject to any disclaimer, the term of this patent is extended or adjusted under 35 U.S.C. 154(b) by 314 days.

(21) Appl. No.: 10/061,346

(22) Filed: Feb. 4, 2002

(65) Prior Publication Data

US 2002/0107168 A1 Aug. 8, 2002

Related U.S. Application Data

(60) Provisional application No. 60/265,611, filed on Feb. 2, 2001.

(51) Int. Cl.[7] ..... C11D 17/00

(52) U.S. Cl. ..... 510/458; 510/459; 530/208; 252/367.1

(58) Field of Search ..... 510/458, 459; 530/208, 209; 252/367.1

(56) References Cited

U.S. PATENT DOCUMENTS 3,887,537 A * 6/1975 Harada et al. ..... 530/208
4,151,160 A * 4/1979 Koebner ..... 530/209
4,483,791 A * 11/1984 Phillips et al. ..... 530/208
6,087,318 A * 7/2000 Jadhav ..... 510/458

FOREIGN PATENT DOCUMENTS

EP 952208 A2 * 10/1999 ..... C11B/13/00

* cited by examiner

*Primary Examiner*—Necholus Ogden

(57) ABSTRACT

A process for obtaining a product rich in unsaponifiable valuable substances from at least one of crude sulphate soap, crude tall oil or tall oil pitch is disclosed. The process comprises (1) providing a feed of at least one of crude sulphate soap, saponified crude tall oil or saponified tall oil pitch, (2) drying the feed, and (3) subjecting the dried feed to high vacuum evaporation to obtain a product rich in unsaponifiable valuable substances, wherein a softener has been incorporated into the dried feed before step (3) to produce a mixed feed. The softener is characterized by the following properties: 1) the mixed feed's viscosity is lower than the feed's viscosity, 2) the softener's vapor pressure is lower than the unsaponifiables of the feed's vapor pressure, 3) the softener's molecular weight is at least 750, and, optionally, 4) the softener is heat resistant.

68 Claims, No Drawings

PROCESS FOR SEPARATING UNSAPONIFIABLE VALUABLE SUBSTANCES FROM SULPHATE SOAP BASED MATERIALS

This application claims the benefit of U.S. Provisional Application No. 60/265,611 filed on Feb. 2, 2001.

BACKGROUND OF THE INVENTION

The invention relates to an improved process for the separation of unsaponifiable substances from crude sulphate soap, crude tall oil or tall oil pitch. Crude sulphate soap (CSS or BLSS) is a by-product of wood pulping and comprises sodium salts of fatty and rosin acids and an unsaponifiable neutral fraction which contains sterols and other neutral components, hereinafter called "valuable substances" or "neutral substances." Crude tall oil (CTO) is made from this soap by acidulation, and tall oil pitch is the distillation residue of CTO.

The invention especially relates to the separation of the neutral substances by means of high vacuum distillation/evaporation, but it is also directed towards the production of fatty acids and other organic acids from the residues obtained from the high vacuum distillation/evaporation process.

Most processes used today to separate and concentrate neutral substances from either CSS, saponified CTO or saponified pitch use solvents, and these processes take advantage of the solubility differences between the unsaponifiable substances and the soap matrix. At present, when using one solvent alone, it is not possible to obtain a reasonable separation of the unsaponifiables from the fatty acid and rosin acid soaps etc. unless extreme process conditions, such as high temperatures and pressures, are used. Because of this, most processes often find it necessary to use more than one solvent, which complicates any recovery and reuse of the solvents, as well as tremendously increasing the costs of the processes.

Some processes for separating unsaponifiable neutral substances from CSS, saponified CTO, or saponified pitch use a high vacuum distillation/evaporation process. These processes take advantage of the volatility differences of volatile unsaponifiables, fatty acid, rosin acid, and almost any other non-volatile organic acid soap. In the case of separation by distillation, the difference between the boiling points of volatile products, such as unsaponifiable components, and the boiling point of different organic acid soaps is so remarkable that separation is possible at a high level of efficiency. However, a problem connected with this separation technique is the very high melting point required. This temperature is close to the decomposition temperature of sodium or potassium soaps (i.e. the sodium or potassium salts of fatty acids and rosin acids). It should be noted that even when melted, these soaps form extremely viscous liquids, which makes industrial handling difficult. While the soaps have to be kept at a high temperature (about 250° C.) in order to maintain their flowability, they are irreversibly decomposed at this temperature, which compromises the separation output and the quality of the final product.

U.S. Pat. No. 3,887,537 discloses a process for recovering fatty acids and rosin acids from tall oil pitch by saponifying the tall oil pitch with an alkali metal hydroxide (sodium hydroxide) in the presence of an alkyl alcohol (such as butanol) to form soaps and unsaponifiables. This mixture is then fed into a thin film evaporator to evaporate and remove the low-boiling matter, including the light unsaponifiables, water and alcohol. Subsequently, the bottom fraction is fed into a second thin film evaporator for the purpose of removing unsaponified heavy material, including sterols. Finally, the bottom soap fraction obtained from the second evaporator is acidulated with a mineral acid to obtain the final product of fatty acids and rosin acids. It should be noted that one of the difficulties with this process is that the soaps are very viscous, thereby making the handling of the soaps troublesome.

WO 99/16785 discloses a method for separating unsaponifiable material from tall oil pitch by saponifying the pitch with a mixture of sodium hydroxide and potassium hydroxide to form sodium and potassium salts of fatty acids and rosin acids. The method then involves the evaporation of the unsaponifiable material which contains sterols using a thin film evaporator. The remaining unevaporated portion of the pitch which comprises sodium and potassium salts of the saponifiable material is then acidulated to create the rosin and fatty acids. Additionally, it is noted that this method also suffers from the previously discussed problem resulting from the difficulty in handling the sodium and/or potassium soaps.

WO 99/42471 discloses a method of separating sterols from tall oil pitch by saponifying the tall oil pitch with an alkali metal base comprising sodium hydroxide, potassium hydroxide or a mixture thereof, followed by neutralizing the saponified pitch with an acid and heating the neutralized pitch to remove water. The resulting pitch, which contains free sterols, is then evaporated to remove light ends. The remaining bottom fraction is then evaporated using a wiped evaporator to produce a light phase distillate containing free sterols. Subsequently, the light phase distillate is dissolved in a solvent comprising an alcohol, and the free sterols are crystallized from the solution by cooling. A disadvantage of this method is that the yield of the sterols is rather low.

U.S. Pat. No. 4,151,160 discloses a process for the separation of fatty acids from the unsaponfiable constituents contained in a head fraction of tall oil by converting the fatty acids into their zinc or lead soaps, and then removing the unsaponifiable constituents by vacuum distillation. Subsequently, the (remaining) non-volatile metal soaps are acidulated to produce the desired fatty acids. Typical components of the light boiling unsaponifiables are long chain alcohols and rosin degradation products, which have minor commercial value. It should be noted that the content of sterols in the tall oil heads is very low, considerably below 1% by weight, which shows that the tall oil head fraction is not a suitable source from which to produce sterols.

U.S. Pat. No. 4,483,791 discloses a process for the recovery of fatty acids from tall oil heads by converting the fatty acids contained in the tall oil heads into a mixture of magnesium soap and sodium soap, and then vacuum stripping the reaction product. Finally, the soaps are then acidulated to produce the desired fatty acids.

EP 0 952 208 A2 discloses a process for the separation of unsaponifiables from BLSS or CTO by dehydrating the raw material and melting and distilling the dehydrated material in a short path evaporation column. This publication also suggests adding unsaponifiables to the soap or neutralized crude tall oil before the drying step in order to reduce the necessary temperature required to maintain the mixture at a state of adequate fluidity during the drying process. The added unsaponifiables comprise recirculated unsaponifiables from the process and they are low boiling substances. The recirculated unsaponifiables have a favourable effect on the drying step but they are believed to have a disadvantageous effect on the subsequent distillation step as the low boiling unsaponifiables are evaporated with the sterol fraction, resulting in a dilution of the sterol fraction. Because they do not remain in the residue fraction, they cannot facilitate the handling of the residue with a viscosity reducing effect as would be the case if they were present in the residue.

SUMMARY OF THE INVENTION

The new process of the present invention has solved the problems associated with the already known evaporation processes for separating sterols and other valuable substances from crude sulphate soap, crude tall oil or tall oil pitch by incorporating a softener material into the saponified feed either prior to, after, or during the drying step, but prior to the evaporation step.

Thus, the present invention provides a process for separating unsaponifiable neutral substances from crude sulphate soap, crude tall oil or tall oil pitch, comprising the steps of:

(a) providing a feed of at least one of crude sulphate soap, saponified crude tall oil or saponified tall oil pitch, (b) providing a softener and incorporating said softener into said feed to produce a mixed feed, wherein said softener possesses the following properties at the operation conditions of the process:

(i) the viscosity of the mixed feed having the softener incorporated therein is lower than the viscosity of the feed without the softener;

(ii) the vapour pressure of the softener is lower than the vapour pressure of the unsaponifiables of the feed;

iii) the molecular weight of the softener is at least 750; and, optionally, iv) the softener is substantially immune to degradation and other side reactions caused by heat;

(c) drying said mixed feed to produce a dried mixed feed; and (d) subjecting the dried mixed feed to a first high vacuum evaporation to obtain a product rich in unsaponifiable valuable substances in the form of a distillate.

Additionally, the present invention provides a process for separating unsaponifiable neutral substances from crude sulphate soap, crude tall oil, or tall oil pitch comprising the steps of:

(a) providing a feed of at least one of crude sulphate soap, saponified crude tall oil or saponified tall oil pitch, (b) drying the feed of step (a) to produce a dried feed; and (c) subjecting the dried feed to a first high vacuum evaporation to obtain a product rich in unsaponifiable valuable substances in the form of a distillate, wherein a softener has been incorporated into said dried feed at any point prior to step (c), to produce a mixed feed, wherein said softener possesses the following properties at the operation conditions of the process:

i) the viscosity of the mixed feed having the softener incorporated therein is lower than the viscosity of the feed without the softener;

ii) the vapour pressure of the softener is lower than the vapour pressure of the unsaponifiables of the feed;

iii) the molecular weight of the softener is at least 750; and, optionally, iv) the softener is substantially immune to degradation and other side reactions caused by heat.

DETAILED DISCLOSURE

As stated above, the present invention has solved the problems associated with the already known evaporation processes for separating sterols and other valuable substances from crude sulphate soap, crude tall oil or tall oil pitch by incorporating a softener material into the saponified feed either prior to, after, or during the drying step, but prior to the evaporation step. Additionally, it has been found that it is preferred that the unsaponifiables of the feed be soluble in the softener; and that the residue remaining after the evaporation steps is also soluble in the softener. Most preferably, though, both the unsaponifiables and the residue remaining after the evaporation steps should be soluble in the softener.

It has also been discovered that the partial vapour pressure of the softener is preferably less than 10% of the partial vapour pressure of the unsaponifiable fraction at the evaporation conditions. It is also preferred that the softener is added to the feed in an amount of 1–500 wt-%, preferably 5–200 wt-%, and more preferably between 10 wt-% and 100 wt-%, calculated on the dry weight of the feed. Preferably, the viscosity of the mixture of feed and softener does not at any stage of the process (providing, incorporating, drying and evaporation) exceed $1.5\times10^6$ cSt (preferably it does not exceed $1\times10^5$ cSt). The distillation bottoms preferably also have a viscosity of at most $1.5\times10^6$ cSt.

It is also possible to use the above process without introducing a softener in the pre-drying stage. It has been discovered that the process retains its efficacy if the softener is added when the feed has already begun drying or is even when the feed is already dry. Preferably, though, the softener is added prior to the vacuum evaporation step.

The role of the softener material is to decrease the viscosity of the material, thereby preventing the inadvertent intake of matter into the equipment and, on the other hand, facilitating the removal of the valuable substances from the low viscous liquid bulk material in the evaporation unit. Not only should the softener have the above properties, but it is optionally substantially heat resistant, and thereby substantially immune to degradation (e.g. less than 10% by weight) and other side reactions occurring because of the conditions, such as elevated temperatures, employed in the process. However, if the softener does not possess these optional properties, then the conditions of the reactions should be regulated so that a sufficient amount of non-degraded softener will survive in order to obtain the intended effect.

Any compound which fulfils the above requirements can be used as softener in the claimed invention. Preferably, that the molecular weight of the softener should be at least 750 and no greater than 6,000. Examples of especially suitable softeners having a molecular weight of at least 1000, preferably at least 2000, are high boiling hydrocarbons; e.g. paraffin waxes, high boiling naphtenes, polyglycols, e.g. polypropylene glycol and polyethylene glycol, as well as high molecular weight silicon oils.

Also, high molecular weight esters defined as having an average molecular weight of about 800, e.g. triglyceride, can be used, provided that the process is operated in such a manner that a sufficient amount of softener remains in the residue following the evaporation step(s). This can be ensured by lowering the pH value of the process to a level of 7 to 10, preferably 8 to 9.5, so as to prevent or minimize the alkaline hydrolysis of the ester.

Preferably, the unsaponifiable neutral substances separated by the process of the present invention comprise sterols.

The feed of step (a) can be obtained by incorporating the softener into a feed of crude sulphate soap. Additionally, the feed of step (a) can also be obtained by saponifying a feed of crude tall oil or tall oil pitch, and subsequently incorporating the softener into the feed of saponified crude tall oil or saponified tall oil pitch. A third method by which the feed of step (a) can be obtained is by incorporating the softener into a feed of crude tall oil or tall oil pitch, and subsequently saponifying the feed having the softener incorporated therein.

According to a preferred embodiment of the present invention, the product which is rich in unsaponifiable valuable substances is obtained as the distillate from the first high vacuum evaporation. This distillate is then preferably subjected to a second high vacuum evaporation to remove light ends of said distillate, and to obtain a product enriched in unsaponifiable valuable substances.

This second product, which is enriched in unsaponifiable valuable substances, can then be subjected to a third high vacuum evaporation to obtain a product even further enriched in unsaponifiable neutral substances. Finally, it is possible to continue to subject the product of the evaporation steps to additional evaporation steps in order to further increase the concentration and/or purity of the neutral substances. Additionally, it is possible to combine all of the evaporation steps into a single process, thereby improving the efficiency of the overall process.

The high vacuum evaporation(s) is (are) preferably carried out in a short path evaporator or wipe film evaporator at a temperature in the range of 100° C. to 350° C. and at a pressure in the range of 25 mbar to about $1\times10^{-3}$ mbar or less. Also, the drying step is preferably carried out in a short path evaporator or in a wipe film evaporator.

According to the invention, the product rich in unsaponifiable valuable substances obtained from the first high vacuum evaporator or the product enriched in unsaponifiable valuable substances obtained from the second high vacuum evaporator or the product being further enriched in unsaponifiable valuable substances obtained from the third high vacuum evaporator can be further purified, for example, by crystallization means, to obtain sterols.

The sterols can be crystallized by any known method involving a solvent mixture comprising at least one, preferably at least two, of the solvents selected from the group consisting of ketones, alkanols, hydrocarbons and water. A preferred solvent mixture comprises methyl ethyl ketone, methanol and water. Another preferred solvent mixture comprises a hydrocarbon, methanol and water.

Other solvents/solvent combinations can be used to crystallize the neutral substances as well. It is known to one of ordinary skill that pure pine based raw material, mixtures of hydrocarbon, methanol and water are suitable. These solvents/solvent combinations include other lower alcohols, their mixtures with themselves and, for example, mixtures with hydrocarbons and/or ketones and/or water.

According to the invention, the crude sulphate soap, the saponified crude tall oil, or the saponified tall oil pitch can be in the form of sodium soaps or potassium soaps or even mixtures thereof. Such sodium and/or potassium soaps can be produced by saponifying crude tall oil or tall oil pitch with a sodium or potassium soap-forming compound such as sodium hydroxide or potassium hydroxide.

The soaps can also be "metal" soaps, such as zinc, iron, manganese, magnesium, calcium or aluminium soaps. Such soaps can be produced by reacting a sodium or potassium soap with a metal soap-forming compound. The crude tall oil or tall oil pitch can also be saponified with a metal soap-forming compound to produce the corresponding metal soap. By using metal soaps, the amount of the softener can be reduced. Furthermore, blends of such metal soaps and sodium/potassium soaps can be used.

According to the invention, the evaporation residue from the first high vacuum evaporation can be further processed, for example by acidulation, to obtain acids, such as fatty and rosin acids. The residue from evaporation contains the softener used in the prior step and this softener can be recovered and be used. By using vegetable oils (such as triglycerides) as softeners, these softeners can also be hydrolysed to obtain fatty acids.

Unsaponifiable valuable substances other than sterols can also be obtained by the process according to the invention. For example, wax alcohols can be obtained as the distillate after performing the second high vacuum evaporation.

The following examples describe the invention more closely. In this specification, the symbol "%" refers to percentages by weight unless otherwise specified.

EXAMPLES

Example 1

First Distillation 5 kg tall oil pitch originated from Scandinavian crude tall oil was saponified by using 10% stoichiometric excess of 20% NaOH solution for 4 hours at 160° C. 2.5 kg of melted paraffin wax consisting mainly of hydrocarbons having chain length (95%)>35 carbon atoms was added and the mixture was dried in a laboratory short path evaporator (200° C., 25 mbar). The mixture was fed again to the short path evaporator, this time the conditions were: feed temperature 200° C., pressure $2\times10^{-3}$ mbar. Evaporation temperature 265° C. 2.15 kg of distillate was received. Sterol content of the distillate was 22.0% (9% in the original pitch).

Example 2

Recycling of Softener

The residue from example 1 was acidulated with sulphuric acid using in principle normal crude tall oil manufacture practice. The formed "crude tall oil" was dried in vacuo and depitched using a short path evaporator. The distilled acid fraction had the acid value of 155 mg KOH/g. The residue from this evaporation was used as the softener in the evaporation trial analogous to the practice described in example 1. The sterol content of the distillate product obtained was 22.3% indicating that the recycling of the softener does not have a detrimental effect on process performance.

Example 3

Second Distillation

The distillate from example 1 was fed again to a short path evaporator. Feed temperature 130° C., pressure $2\times10^{-3}$ mbar and the evaporation temperature was 160° C. The distillate (lights) fraction consisted of 18% of the mass of the feed and the sterol content was 9%. The main part (93%) of the sterols in the feed remained in the residue.

Example 4

Third Distillation

The residue from the example 3 was taken into a short path evaporator again. The evaporation conditions were:

feed temperature 130° C., pressure $2\times10^{-3}$ mbar and the evaporation temperature was 260° C. The distillate recovered consisted of 85% of the feed's mass and the sterol content was 35%.

Example 5

Crystallization of Sterols 10 g distillate from the example 4 was dissolved into 15 g of solvent mixture consisting of methyl ethyl ketone, methanol and water (70:20:10) under reflux. After letting this solution cool to room temperature, the crystals were filtrated and washed with the same solvent composition. The sterol purity was 95%.

In this example, the crystallization of sterols takes place by using third stage distillate as raw material. This maximizes the purity of the valuable sterol product. However, when the raw material is of good quality or when especially high purity of the product is not needed, it is not always necessary to make all of the above mentioned distillation steps. Hence, the recovery of valuable substances is possible from fractions obtained from any distillation step.

Example 6

5 kg tall oil pitch originated from pure pine based crude tall oil (from South East USA) was saponified by using 10% stoichiometric excess of 20% NaOH solution for 4 hours at 160° C. 2.5 kg of high molecular weight polypropylene glycol was added and the mixture was dried in a laboratory short path evaporator (200 C, 25 mbar). The mixture was fed again to the short path evaporator, this time the conditions were: feed temperature 200° C., pressure $2\times10^{-3}$ mbar. Evaporation temperature was 270° C. 1.4 kg of distillate was received. Sterol content of the distillate was 27.0% (13% in the original pitch).

Example 7

Crude tall oil (originating from South American *Pinus radiata* wood) containing 6% sterols was saponified by using a 5% stoichiometric excess calculated the saponification value of a mixture 30% NaOH/KOH (very slow addition with good mixing, 1 h heating time at 90° C.). After the saponification, excess alkali was neutralized by bubbling carbon dioxide through the soap formation. (The soap was fed into the stream). The rapeseed oil was combined with the soap stream just before the inlet of the short path evaporator in order to avoid the hydrolysis of the oil. The evaporation conditions were: a short path evaporator with a stream of rapeseed oil (approximately ⅓ of the mass of the soap in this drying step) pressure 30 mbar, temperature 150° C. The dried soap/fat mixture was distilled again in the same short path unit using $2\times10^{-3}$ mbar pressure and 270° C. temperature. About 12% distillate based on the CTO was recovered. Sterol content was 32%.

Example 8

Activation of the Residue from Example 7

The residue from example 7 was acidulated with 30% sulphuric acid in the manner used normally in soap acidulation, the end pH was 2. The product was taken into a pressure vessel with the brine formed and heated 1 hour at 120° C., in order to split the rapeseed oil in the mixture. After cooling to 90° C. the brine phase was separated and the oil layer washed twice with water. The acid value of dried oil was 185 mg KOH/g.

Alkaline hydrolysis followed by reacidulation was used for the recovery of rapeseed fatty acids from the residue.

I claim:

1. A process for obtaining a product rich in unsaponifiable valuable substances from at least one of crude sulphate soap, crude tall oil or tall oil pitch, comprising the steps of:

(a) providing a feed of at least one of crude sulphate soap, saponified crude tall oil or saponified tall oil pitch, (b) providing a softener and incorporating said softener into said feed to produce a mixed feed, wherein said softener possesses the following properties at the operation conditions of the process:

(i) the viscosity of the mixed feed having the softener incorporated therein is lower than the viscosity of the feed without the ener;

(ii) the vapour pressure of the softener is lower than the vapour pressure of the unsaponifiables of the feed;

iii) the molecular weight of the softener is at least 750; and, optionally, iv) the softener is substantially immune to degradation and other side reactions caused by heat;

(c) drying said mixed feed to produce a dried mixed feed; and (d) subjecting the dried mixed feed to a first high vacuum evaporation to obtain a product rich in unsaponifiable valuable substances in the form of a distillate.

2. The process of claim 1, wherein the mixed feed of step (b) is obtained by incorporating the softener into a feed of crude sulphate soap.

3. The process of claim 1, wherein the mixed feed of step (b) is obtained by saponifying a feed of crude tall oil or tall oil pitch, and subsequently incorporating the softener into the feed of saponified crude tall oil or saponified tall oil pitch.

4. The process of claim 1, wherein the mixed feed of step (b) is obtained by incorporating the softener into a feed of crude tall oil or tall oil pitch, and subsequently saponifying the feed having the softener incorporated therein.

5. The process of claim 1, wherein said distillate is subjected to a second high vacuum evaporation to remove light ends of said distillate and to obtain a product enriched in unsaponifable valuable substances.

6. The process of claim 1, wherein said product enriched in unsaponifiable valuable substances is subjected to a third high vacuum evaporation to obtain a product being further enriched in unsaponifiable valuable substances.

7. The process of claim 1, wherein the product rich in unsaponifiable valuable substances is subjected to a crystallization step to obtain sterols.

8. The process of claim 5, wherein the product enriched in unsaponifiable valuable substances is subjected to a crystallization step to obtain sterols.

9. The process of claim 6, wherein the product being further enriched in unsaponifiable valuable substances is subjected to a crystallization step to obtain sterols.

10. The process of claim 7, wherein said crystallization step comprises using a solvent or a solvent mixture comprising at least one or two of the solvents selected from the group consisting of ketones, alkanols, hydrocarbons and water to crystallize the sterols from the unsaponifiable valuable substances.

11. The process of claim 8, wherein said crystallization step comprises using a solvent or a solvent mixture comprising at least one or two of the solvents selected from the group consisting of ketones, alkanols, hydrocarbons and water to crystallize the sterols from the unsaponifiable valuable substances.

12. The process of claim 9, wherein said crystallization step comprises using a solvent or a solvent mixture comprising at least one or two of the solvents selected from the group consisting of ketones, alkanols, hydrocarbons and water to crystallize the sterols from the unsaponifiable valuable substances.

13. The process of claim 1, wherein the crude sulphate soap or the saponified crude tall oil or the saponified tall oil pitch is in the form of sodium and/or potassium soaps.

14. The process of claim 1, wherein the evaporation residue from the first evaporation is acidulated to obtain acids and said acids are recovered, and the residue is re-used as said softener.

15. The process of claim 1, wherein said softener is selected from the group consisting of high boiling hydrocarbons, high boiling naphtenes, polyglycols, high molecular weight silicon oils and high molecular weight esters.

16. The process of claim 1, wherein the amount of said softener used is between 1 wt-% and 500 wt-% based on the dry weight of the feed.

17. The process of claim 1, wherein the unsaponifiables are soluble in the softener.

18. The process of claim 1, wherein the softener is not resistant to degradation and other side reactions.

19. The process of claim 18, wherein the reactions are regulated so as to ensure that there is a sufficient amount of non-degraded softener remaining in the mixed feed to achieve the intended effect.

20. The process of claim 1, wherein the molecular weight of the softener is at least 1,000.

21. The process of claim 20, wherein the molecular weight of the softener is at least 2,000.

22. The process of claim 1, wherein the softener is a high molecular weight ester, and wherein the process further comprises a pH value of 7–10.

23. The process of claim 22, wherein the pH value is 8–9.5.

24. The process of claim 6, in which the evaporation steps are carried out at a temperature of 100–350° C. and at a pressure no higher than 25 mbar.

25. The process of claim 10, wherein the mixture comprises methyl ethyl ketone, methanol and water.

26. The process of claim 11, wherein the mixture comprises methyl ethyl ketone, methanol and water.

27. The process of claim 12, wherein the mixture comprises methyl ethyl ketone, methanol and water.

28. The process of claim 10, wherein the mixture comprises a hydrocarbon, methanol and water.

29. The process of claim 11, wherein the mixture comprises a hydrocarbon, methanol and water.

30. The process of claim 12, wherein the mixture comprises a hydrocarbon, methanol and water.

31. A process for obtaining a product rich in unsaponifiable valuable substances from at least one of crude sulphate soap, crude tall oil or tall oil pitch, comprising the steps of:

(a) providing a feed of at least one of crude sulphate soap, saponified crude tall oil or saponified tall oil pitch, (b) drying the feed of step (a) to produce a dried feed; and (c) subjecting the dried feed to a first high vacuum evaporation to obtain a product rich in unsaponifiable valuable substances in the form of a distillate, wherein a softener is incorporated into said dried feed at any point prior to step (c), to produce a mixed feed, wherein said softener possesses the following properties at the operation conditions of the process:

(i) the viscosity of the mixed feed having the softener incorporated therein is lower than the viscosity of the feed without the softener;

ii) the vapour pressure of the softener is lower than the vapour pressure of the unsaponifiables of the feed;

iii) the molecular weight of the softener is at least 750; and, optionally, iv) the softener is substantially immune to degradation and other side reactions caused by heat.

32. The process of claim 31, wherein the mixed feed of step (c) is obtained by incorporating the softener into a feed of crude sulphate soap.

33. The process of claim 31, wherein the mixed feed of step (c) is obtained by saponifying a feed of crude tall oil or tall oil pitch, and subsequently incorporating the softener into the feed of saponified crude tall oil or saponified tall oil pitch.

34. The process of claim 31, wherein the mixed feed of step (c) is obtained by incorporating the softener into a feed of crude tall oil or tall oil pitch, and subsequently saponifying the feed having the softener incorporated therein.

35. The process of claim 31, wherein said distillate is subjected to a second high vacuum evaporation to remove light ends of said distillate and to obtain a product enriched in unsaponifable valuable substances.

36. The process of claim 31, wherein said product enriched in unsaponifiable valuable substances is subjected to a third high vacuum evaporation to obtain a product being further enriched in unsaponifiable valuable substances.

37. The process of claim 31, wherein the product rich in unsaponifiable valuable substances is subjected to a crystallization step to obtain sterols.

38. The process of claim 35, wherein the product enriched in unsaponifiable valuable substances is subjected to a crystallization step to obtain sterols.

39. The process of claim 36, wherein the product being further enriched in unsaponifiable valuable substances is subjected to a crystallization step to obtain sterols.

40. The process of claim 37, wherein said crystallization step comprises using a solvent or a solvent mixture comprising at least one or two of the solvents selected from the group consisting of ketones, alkanols, hydrocarbons and water to crystallize the sterols from the unsaponifiable valuable substances.

41. The process of claim 38, wherein said crystallization step comprises using a solvent or a solvent mixture comprising at least one or two of the solvents selected from the group consisting of ketones, alkanols, hydrocarbons and water to crystallize the sterols from the unsaponifiable valuable substances.

42. The process of claim 39, wherein said crystallization step comprises using a solvent or a solvent mixture comprising at least one or two of the solvents selected from the group consisting of ketones, alkanols, hydrocarbons and water to crystallize the sterols from the unsaponifiable valuable substances.

43. The process of claim 31, wherein the crude sulphate soap or the saponified crude tall oil or the saponified tall oil pitch is in the form of sodium and/or potassium soaps.

44. The process of claim 31, wherein the evaporation residue from the first evaporation is acidulated to obtain acids and said acids are recovered, and the residue is re-used as said softener.

45. The process of claim 31, wherein said softener is selected from the group consisting of high boiling hydrocarbons, high boiling naphtenes, polyglycols, high molecular weight silicon oils and high molecular weight esters.

46. The process of claim 31, wherein the amount of said softener used is between 1 wt-% and 500 wt-% based on the dry weight of the feed.

47. The process of claim 31, wherein the unsaponifiables are soluble in the softener.

48. The process of claim 31, wherein the softener is not resistant to degradation and other side reactions.

49. The process of claim 48, wherein the reactions are regulated so as to ensure that there is a sufficient amount of non-degraded softener remaining in the mixed feed to achieve the intended effect.

50. The process of claim 31, wherein the molecular weight of the softener is at least 1,000.

51. The process of claim 50, wherein the molecular weight of the softener is at least 2,000.

52. The process of claim 31, wherein the softener is a high molecular weight ester, and wherein the process further comprises a pH value of 7–10.

53. The process of claim 52, wherein the pH value is 8–9.5.

54. The process of claim 36, in which the evaporation steps are carried out at a temperature of 100–350° C. and at a pressure no higher than 25 mbar.

55. The process of claim 40, wherein the mixture comprises methyl ethyl ketone, methanol and water.

56. The process of claim 41, wherein the mixture comprises methyl ethyl ketone, methanol and water.

57. The process of claim 42, wherein the mixture comprises methyl ethyl ketone, methanol and water.

58. The process of claim 40, wherein the mixture comprises a hydrocarbon, methanol and water.

59. The process of claim 41, wherein the mixture comprises a hydrocarbon, methanol and water.

60. The process of claim 42, wherein the mixture comprises a hydrocarbon, methanol and water.

61. The process of claim 46, wherein the amount of said softener used is between 5 wt-% and 200 wt-% based on the dry weight of the feed.

62. The process of claim 16, wherein the amount of said softener used is between 5 wt-% and 200 wt-% based on the dry weight of the feed.

63. The process of claim 61, wherein the amount of said softener used is between 10 wt-% and 100 wt-% based on the dry weight of the feed.

64. The process of claim 62, wherein the amount of said softener used is between 10 wt-% and 100 wt-% based on the dry weight of the feed.

65. The process of claim 6, wherein the product being further enriched in unsaponifiable valuable substances is subjected to further evaporation steps, resulting in a product being highly enriched in unsaponifiable valuable substances.

66. The process of claim 36, wherein the product being further enriched in unsaponifiable valuable substances is subjected to further evaporation steps, resulting in a product being highly enriched in unsaponifiable valuable substances.

67. The process of claim 65, wherein the evaporation steps are conducted as a single distillation step.

68. The process of claim 66, wherein the evaporation steps are conducted as a single distillation step.

* * * * *